United States Patent [19]

Farr et al.

[11] 4,273,010

[45] Jun. 16, 1981

[54] POWER TONG

[76] Inventors: Garth M. Farr, 1620 Magnolia La., Kingwood, Tex. 77339; Terence D. McCoy, Site 16, Box 1, R.R.1, Spruce Grove, Edmonton, Alberta; Jiri Dlask, 121 Tudor La., Edmonton, Alberta, all of Canada

[21] Appl. No.: 61,619

[22] Filed: Jul. 31, 1979

[51] Int. Cl.[3] ..... B25B 17/00

[52] U.S. Cl. ..... 81/57.18; 81/57.2

[58] Field of Search ..... 81/57.18, 57.2, 57.21, 81/57.15

[56] References Cited

U.S. PATENT DOCUMENTS

| | | | |
|---|---|---|---|
| 2,879,680 | 3/1959 | Beeman | 81/57.18 |
| 3,180,186 | 4/1965 | Catland | 81/57.18 |
| 3,261,241 | 7/1966 | Catland | 81/57.18 |
| 4,084,453 | 4/1978 | Eckel | 81/57.18 |

*Primary Examiner*—James L. Jones, Jr.

*Attorney, Agent, or Firm*—Arnold, White & Durkee

[57] ABSTRACT

An open mouth power tong is described having a novel arrangement for preventing relative rotation between the tong cage plates and rotary gear in situations where the pipe is not gripped at the completion of the camming action and in situations where the tong parts must be aligned for placing the tong on a pipe or removing it from a pipe. The assembly includes a pair of arcuate grooves formed in the upper surface of the rotary gear--one for use in make up operations and the other for use in break out operations. A rigid pin member is provided for extending through one of a pair of apertures formed in the upper cage plate. When the camming action is complete, i.e., when the cam followers have reached the extremities of the cam surfaces, the rigid pin member engages the remote boundary of the respective arcuate groove so as to join the cage plates and rotary gear and cause them to rotate together. When it is desired to align the tong parts for pipe access, the pin engages the near boundary of the groove.

10 Claims, 8 Drawing Figures

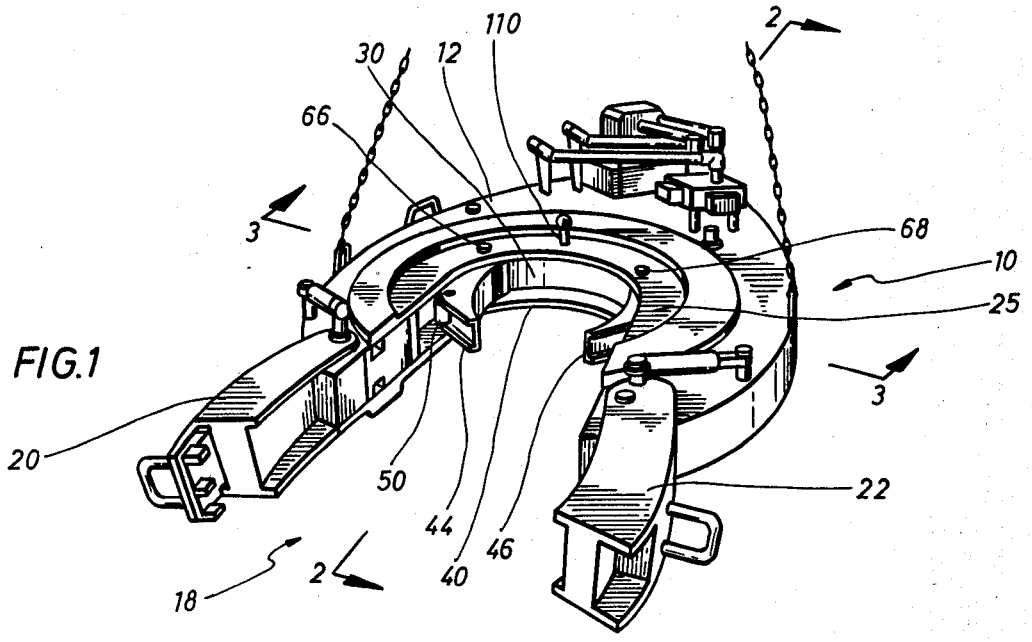
FIG.1
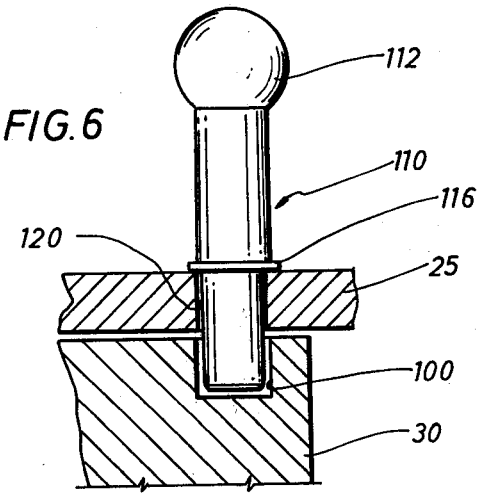
FIG.6
FIG.7
PRIOR ART
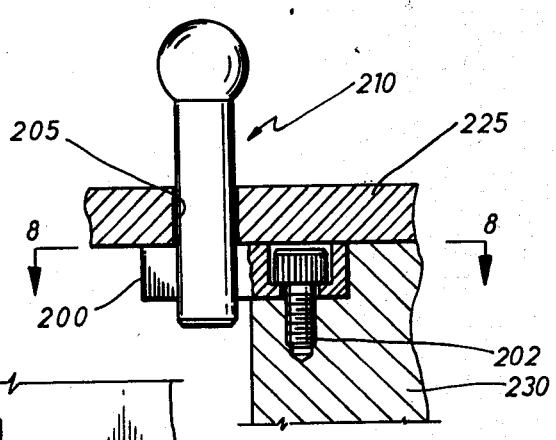
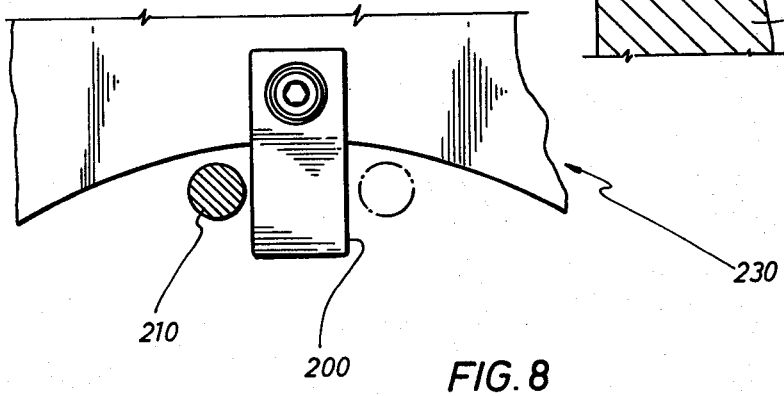
FIG. 8
PRIOR ART

POWER TONG

BACKGROUND OF THE INVENTION

1. Field of the Invention

The present invention relates to power wrenches and, more specifically, to power tongs for making up and breaking out threaded connections between adjoining tubular members. In particular, the invention relates to a novel arrangement used to join the tong cage plates and the rotary gear for joint rotation to facilitate proper alignment of the tong parts for placing the tong on the pipe or removing the tong from the pipe. The novel arrangement also serves the novel function of preventing so-called "overcamming" situations wherein the pipe gripping mechanism of the tong does not grip the pipe due to various factors, such as the jaws undersized or the pipe being undersized.

2. Description of the Prior Art

Oil field tubular members, e.g., drill pipe and casing, are employed in sections which are jointed together at their ends by threaded connections. Power tongs of the type herein described are utilized to make up and break out these threaded connections by securely gripping one tubular member and rotatably driving that member relative to the adjoining member. Tongs representative of present practice in the industry are described in U.S. Pat. Nos. 2,879,680; 3,180,186; 3,261,241 and 4,084,453.

When a power tong is used to grip and rotate a pipe section, a pipe-gripping mechanism as described, for example, in U.S. Pat. No. 2,879,680, is utilized to bring a pair of jaws into contact with the pipe. The jaws are pivotally mounted by bolts which pass through the jaws. The bolts are secured at their ends to the so-called "upper and lower cage plates". The cage plates are generally arcuate plates that are adapted to rotate with the jaws after the pipe has been securely gripped. The jaws are movable into and out of engagement with the pipe section by means of a camming action caused by jaw rollers (cam followers) which travel on machined cam surfaces of a rotatably driven rotary gear.

In pipe gripping operations, the jaws (or dies carried thereon) may fail to securely grip the pipe due to various factors. In such cases it is desirable to refrain further relative movement between the rotary gear and cage plate to prevent dangerous overcamming situations where the rotary gear continues to rotate after the camming action fails. No known tong structure adequately solves this problem.

A second problem in tong operation addressed by the instant invention is that of alignment of the tong parts prior to placing the tong on the pipe or removing the tong from the pipe. In an open mouth tong of the type described herein, three openings must be aligned before the tong may be placed on or removed from a pipe—the tong throat, the rotary gear mouth and the cage plate mouth. According to prior art practice as illustrated in FIGS. 7 and 8, this alignment function has been accomplished by the use of a backing lug/backing pin arrangement. According to this prior art technique, a "backing lug" 200 is secured to the inside surface of the rotary gear 230 by means of a fasterner 202 and protrudes toward the center of the tong. The backing lug 200 cooperates with a backing pin 210 which may be placed into either of two openings in the upper cage plate 225 (opening 205 shown in FIG. 7). In the operation of this well-known prior art assembly in a make up operation, after the casing has been made up to the desired torque the rotary gear is driven in the reverse direction to disengage the jaws and rotates in that direction until the backing lug 200 engages the backing pin 210. At the point of this engagement the mouths of the rotary gear and cage plates are aligned and with continued rotation of the rotary gear and cage plates may be rotated to the point where the aligned mouths align with the throat of the tong. At this time all three openings are aligned and the tong may be removed from the pipe. A reverse operation is utilized for removing the tong after a break out operation.

A problem associated with the described prior art technique is that in situations where the rotary gear is rotating at a relatively fast rate of speed (for example, when the rong is in high gear and the throttle valve is completely open) the force exerted at the instant the backing lug contacts the backing pin may result in a sheared backing pin or a sheared backing lug, or both. Such situations are costly in terms of time of replacement and repair since the tong must be partially disassembled to replace a backing lug and due to the further problem that a broken pin may fall downhole and cause problems for rig operation personnel.

The described alignment technique has proved moderately successful in practice, but has caused the noted problems with reliability and tong downtime. It is an object of the present invention to overcome the disadvantages associated with this and other prior art techniques and to provide means for preventing costly and dangerous overcamming situations.

SUMMARY OF THE INVENTION

In accordance with the present invention there is provided a power tong for making up and breaking out connections between adjoining tubular members. Specifically, the instant invention provides a power tong having a novel arrangement for preventing dangerous "overcamming" situations when the gripping elements of the tong fail to grip the pipe after the camming action is substantially complete and for facilitating the alignment of the tong parts when it is desired to place the tong on a pipe or remove the tong from the pipe.

In a particular embodiment the power tong of the present invention comprises a frame with a pipe receiving throat and mounting cage plates, a rotary gear mounted for rotation within the frame, means for rotatably driving the rotary gear, cam surfaces on the inner surface of the rotary gear, pipe-gripping means which include gripping elements and cam follower rollers for engaging the cam surfaces and urging the gripping elements into engagement with the pipe, a pair of arcuate grooves formed in the upper surface of the rotary gear, a pair of apertures formed in the upper cage plate residing above the rotary gear, and a pin member sized to pass through either one of said openings and into a respective groove for joining the frame and the rotary gear for joint rotation when the pin engages the ends or boundaries of the grooves during rotation of the rotary gear.

BRIEF DESCRIPTION OF THE DRAWINGS

FIG. 1 is a pictorial view of an open mouth power tong constructed in accordance with the present invention.

FIG. 6 is a section view taken substantially along line 6—6 of FIG. 5 and illustrating the pin extending through one of the two openings in the cage plate and into one of the grooves in the rotary gear.

FIG. 7 is a top view of a "backing lug/backing pin" arrangement constructed according to prior art practices.

FIG. 8 is a vertical section view taken substantially along line 8—8 of FIG. 7 showing the prior art arrangement.

DETAILED DESCRIPTION OF THE PREFERRED EMBODIMENT

Figure 3:
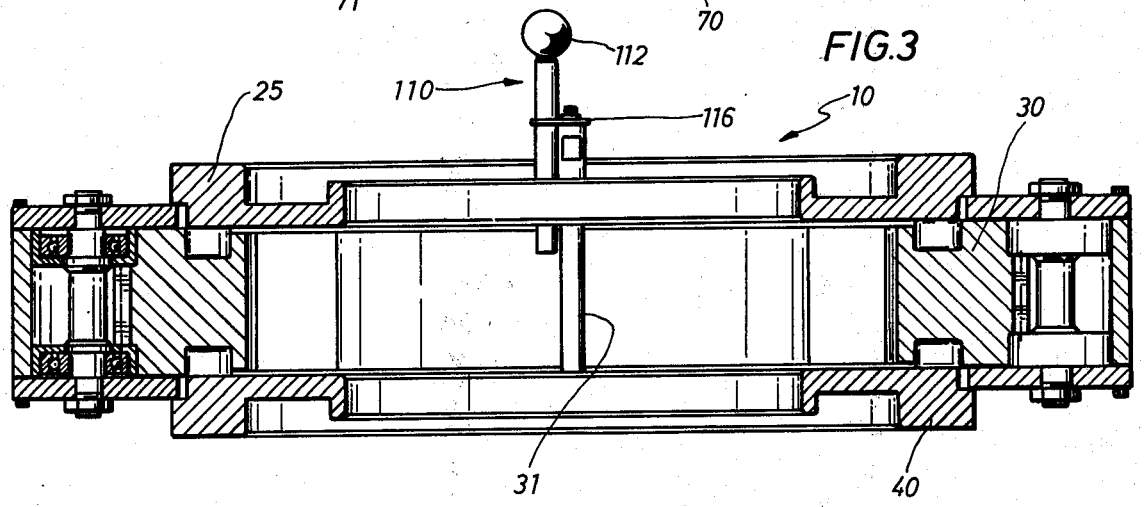
FIG. 3 is a transverse section view of the tong taken substantially along line 3—3 of FIG. 1.
Figure 2:
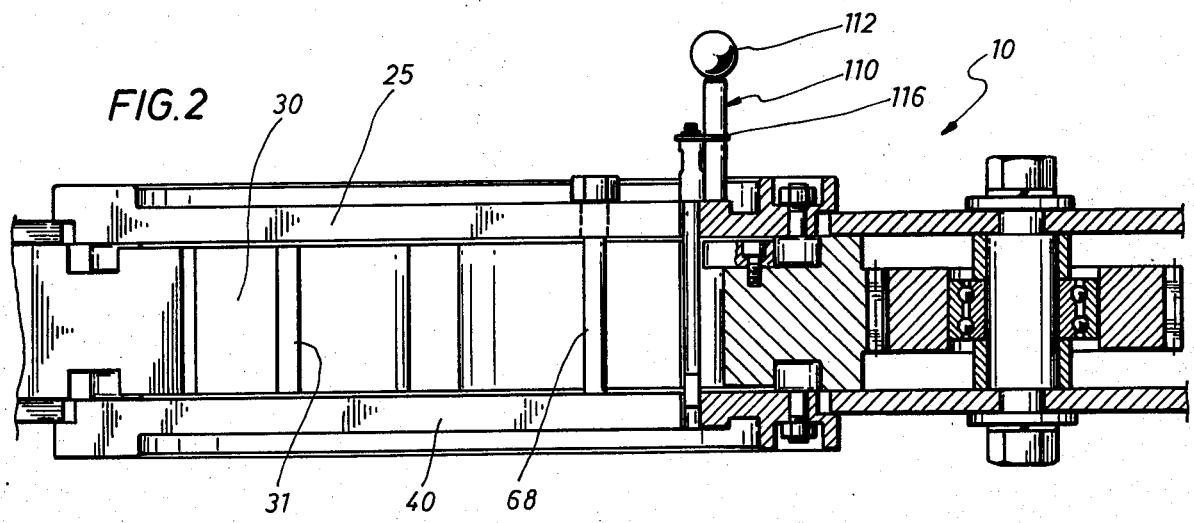
FIG. 2 is a longitudinal section view of the tong taken substantially along line 2—2 of FIG. 1.

Referring to the drawings and in particular to FIGS. 1-3, an open-mouth power tong 10 constructed in accordance with a preferred embodiment of the present invention is shown. Tong 10 includes a frame 12 comprising upper and lower surfaces connected by sidewalls. A body plate of the upper surface supports an upper cage plate 25 which, in turn, pivotally supports the jaws 44, 46 utilized to grip the pipe sections. A lower cage plate 40 is connected for rotation with the upper cage plate 25 and also supports the jaws. The cage plates are joined by suitable spacers such as spacers 31 shown in FIGS. 2 and 3. Frame 12 defines a frontal throat 18 for receiving the pipe sections. When a pipe section is centrally located within the frame during operation, throat 18 is closed off by means of pivotally mounted door members 20, 22 in the manner well known in the art.

The pipe-gripping mechanism of the tong will be described with primary reference to FIGS. 1, 4 and 5. A rotary gear 30 is mounted within frame 12 for rotation relative to the frame. Rotary gear 30 includes gear teeth 32 (FIG. 4) on its outer periphery so that it may be driven in the manner well known in the art, for example, by means of a plurality of pinion gears. The pinion gears, in turn, may be suitably driven by a hydraulic drive train or other drive system. The inner surface of the rotary gear 30 is substantially circular and includes cam means comprising curved cam surfaces 70, 71, 72, 73 for urging the pipe-gripping elements into contact with the pipe. In the illustrated embodiment the pipe-gripping elements comprise dies 36, 37, 38, 39 mounted on a pair of pivotally mounted jaws 44, 46. The jaws are urged toward the pipe P by means of cam followers comprising jaw rollers 50, 52 which are rotatably mounted on the jaws by pins 56, 58. The jaws 44, 46 are, in turn, pivotally mounted between the cage plate 25 and 40 by means of jaw pivot bolts 66, 68. Rollers 50, 52 are adapted to ride on the cam surface 70, 71, 72, 73 on the interior of the rotary gear 30.

During a typical "make up" operation, the rotary gear 30 is driven in a clockwise direction so that jaw rollers 50, 52 ride along their respective cam surfaces 70, 73 until the dies engage the pipe section. As gripping occurs, the cage plate begins to rotate in conjunction with any further rotation of the rotary gear due to the jaw pivot bolts 66, 68 being secured to the cage plates. This rotation continues until a desired torque reading is achieved on the torque gauge. If, however, the pipe is undersized or if the jaw roller is worn or undersized or a combination of these conditions exists, it becomes possible for the jaw rollers 50, 52 to travel the entire length of the cam surfaces 70, 73 without the jaw dies making a gripping contact with the pipe. When this condition exists the jaw rollers will travel past the extremities of the cam surfaces and the rotary gear will continue rotation relative to the cage plates. The foregoing condition is referred to in the art as "overcamming".

Figure 4:
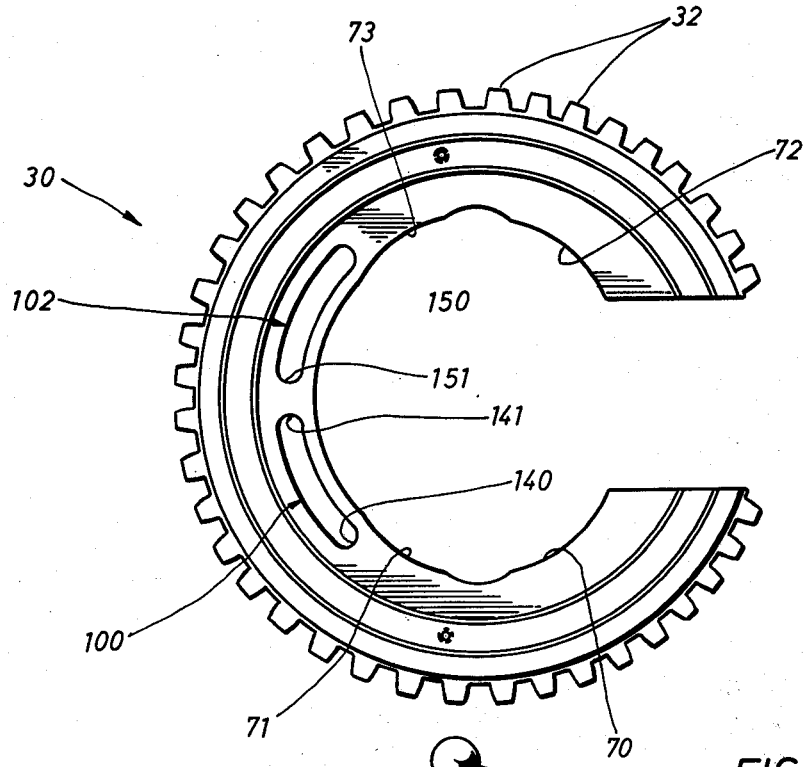
FIG. 4 is a top view of the rotary gear including the grooves or recesses of the present invention.
Figure 5:
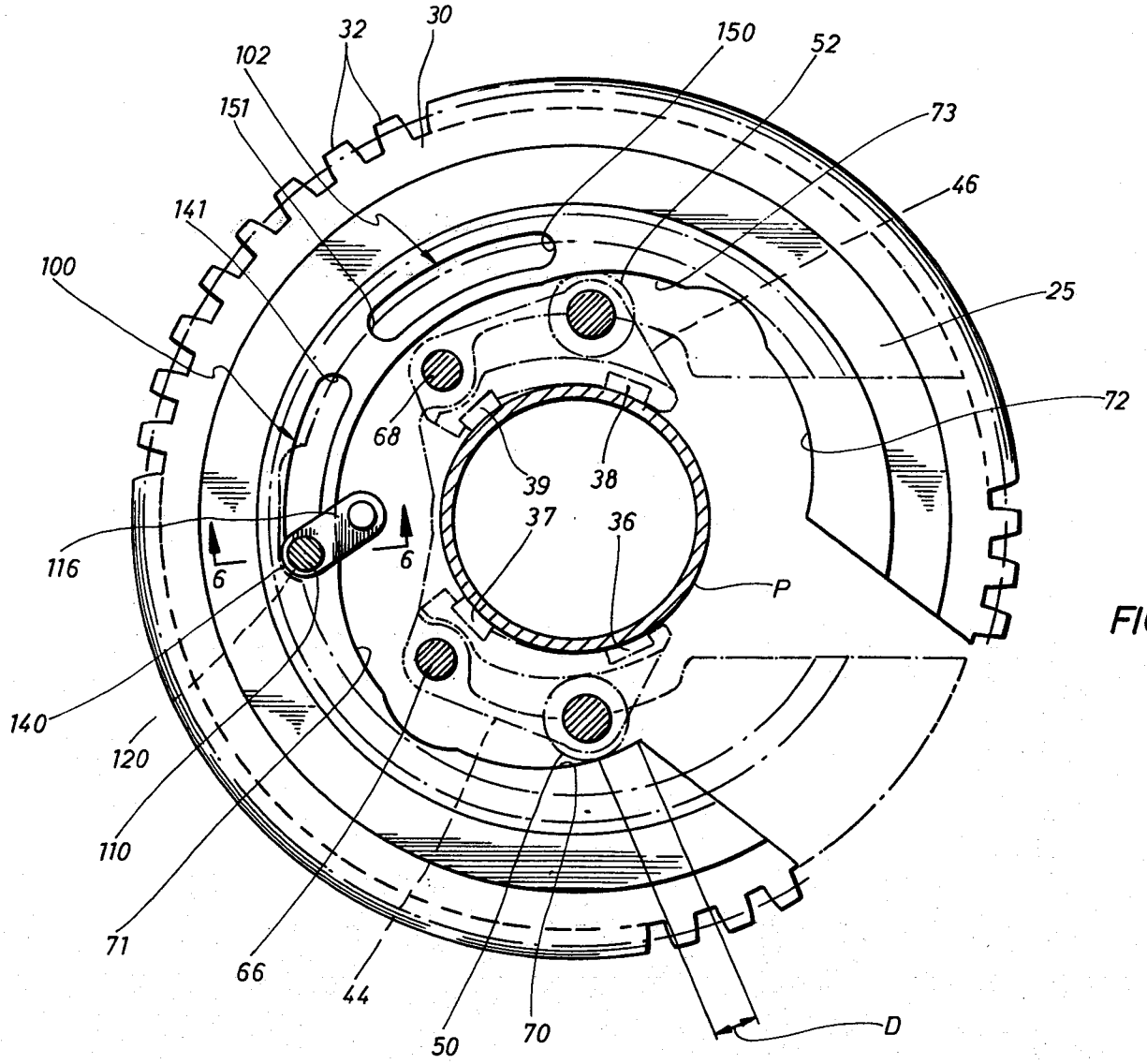
FIG. 5 is a view similar to FIG. 4 illustrating the rotary gear with the cage plates, jaws, and pin in an operative position as the pin/recess combination of the invention prevents overcamming during a make up operation. The initial, or neutral, position of the rotary gear is shown in phantom.

According to the present invention, two radial grooves or recesses 100, 102 are machined into the top surface of the rotary gear (see FIGS. 4 and 5). Make-up recess 100 is used in make-up operations and break-out recess 102 is used in break-out operations in the manner described below. An elongate pin 110 having a hand engageable knob 112 is movably secured to the upper cage plate by means of a pin mount 116. Mount 116 enables pin 110 to be moved to either a first make-up aperture 120 or a second break-out aperture 122 in the upper cage plate. Thus, as shown in FIGS. 5 and 6, which represents the utilization of the invention in a make-up operation, pin 110 is adapted to pass through make-up aperture 120 in upper cage plate 30 into make-up groove 100.

Initially, the rotary gear is positioned in relation to the cage plates so that pin 110 may be inserted through aperture 120 and into recess 100. As the rotary gear rotates, pin 110 moves arcuately inside groove 100 allowing the jaw cam action to function as earlier described. In those instances where a pipe is undersized or the jaw rollers are undersized or worn, or a combination of both conditions exists such that the jaws do not grip the pipe before the rollers reach the extremities of the cam surfaces, an overcamming situation is prevented due to the calculated length of the radial grooves. In such an instance, pin 110 simply moves to the remote boundary 140 of groove 100 and, if the jaws have not gripped the pipe by this time, the cage plates will begin rotating in conjunction with the rotary gear. Referring to FIG. 5, it will be noted that the roller 50 stops its motion at a safety distance "D" from the mouth of the rotary gear. In such instances where gripping fails to occur, the operator may choose, for example, to replace the jaw rollers 50, 52 with larger rollers.

A second function of the above-described combination is in the alignment of the rotary gear mouth and the cage plate mouth when it is necessary to initially place the tong over the pipe or remove the tong from the pipe. As stated above, the tong frame includes a throat 18. When placing the tong on pipe or removing the tong, there are three openings which must be aligned--throat 18, the rotary gear mouth the cage plate mouth. The apparatus of the instant invention provides a reliable and simple means for accomplishing this function. For example, when a make-up operation is complete and it is desired to remove the tong from the pipe, the direction of rotary gear rotation may be reversed to counterclockwise so that pin 110 retraces its path through groove 100. When pin 110 reaches the near boundary 141 of groove 100, the rotary gear mouth and cage plate mouth will be aligned and the pin's engagement with near boundary 141 will cause the cage plate and rotary gear to begin rotation together. Rotation is continued until the aligned mouths of the rotary gear and cage plates come into alignment with the throat 18 of the tong. At this point, the tong may be removed from the pipe.

The foregoing description of operation describes the prevention of overcamming and the alignment of the rotary gear and cage plate mouths with the tong throat in make-up operations. The same functions may be achieved in break-out operations wherein pin 110 is inserted through opening 122 into groove 102 (having a near boundary 151 and a remote boundary 150) and the direction of rotary gear rotation is reversed.

Thus, it can be seen that a relatively simple, safe and reliable means has been provided for preventing dangerous and costly overcamming situations in the operation of power tongs and for performing the rotary gear/cage plate alignment function previously performed by the backing lug/backing pin combination.

While the present invention has been disclosed in connection with an illustrative embodiment, numerous modifications may be made without departing from the spirit or scope of the invention. For example, the means for connecting the rotary gear to the cage plates has been shown as an elongated pin 110. Other rigid members may be used to pass through an opening in the cage plate and into the groove. Also, the recesses in the rotary gear have been shown as arcuate grooves; but it will be appreciated that other shapes of recesses may be used provided the "boundaries" of the recesses serve to engage the pin or rigid member at the appropriate times. Furthermore, although the engagement of the pin with the recess remote boundaries has been set forth as preferably occurring when the rollers (cam followers) reach the extremities of the cam surfaces, it will be appreciated that the engagement may take place with the rollers still on the cam surfaces or after the rollers have left the cam surfaces. Finally, it will also be appreciated that a single continuous recess or groove may be provided in the rotary gear if it is desired to accomplish only the overcamming prevention function. In this situation, with a properly chosen length for the single groove, only one aperture need be provided on the cage plate for the pin. These and other variations are within the true spirit and scope of the invention.

What is claimed is:

1. In a power tong of the type having a frame with a pipe-receiving throat and mounting a rotatable portion, a rotary gear mounted for rotation within the frame, means for rotatably driving the rotary gear, cam means on the inner surface of said rotary gear and pipe-gripping means including gripping elements and cam follower means for engaging said cam means and urging said gripping elements into engagement with a pipe section, the improvement comprising at least one arcuate groove formed in a surface of said rotary gear, an aperture in the frame rotatable portion residing proximate said groove and means sized to pass through said opening and into said groove for joining said frame rotatable portion and said rotary gear for joint rotation when the cam follower means is proximate the end of the cam means during pipe gripping operations.

2. A power tong as claimed in claim 1 wherein said means sized to pass through said opening comprises a pin member.

3. A power tong as claimed in claim 1 wherein said rotary gear includes a pair of arcuate grooves symmetrically disposed on said rotary gear intermediate the opposing pairs of cam surfaces, a first groove for use during make up operations and a second groove for use during break out operations, each said groove having both a near and remote boundary with the near boundary engaging said sized means for tong alignment and with the remote boundary engaging said sized means to prevent overcamming.

4. A power tong as claimed in claim 3 wherein said means sized to pass through said opening comprises a pin member selectively positionable within either said first groove or said second groove through either of a pair of apertures in the frame rotatable portion.

5. A power tong as claimed in claim 4 wherein said frame rotatable portion comprises a cage plate.

6. A power tong comprising:

a frame with a pipe-receiving throat, said frame supporting upper and lower cage plates joined for rotation together, said upper cage plate including at least one aperture for passing a rigid member therethrough;

a rotary gear mounted for rotation within said frame, said rotary gear having a substantially circular inner surface defining an opening in line with similar openings in the cage plates for substantially encompassing a pipe section;

means for rotatably driving said rotary gear;

cam means formed on the circular inner surface of said rotary gear;

pipe-gripping means including gripping elements and including cam follower means for engaging said cam means and for urging said gripping elements into engagement with a pipe section when said rotary gear is rotatably driven relative to said cage plate;

at least one recess formed in the upper surface of said rotary gear;

a rigid member sized to pass through said upper cage plate aperture and having a lower terminal end portion sized to reside in said rotary gear recess; and said recess having remote boundaries for engaging said rigid member end portion when said cam follower means reaches a point proximate the extremity of said cam during pipe-gripping operations, whereby said recess and rigid member cooperate to cause said rotary gear and cage plates to rotate together in prevention of overcamming situations.

7. A power tong as claimed in claim 6 wherein said recess comprises an arcuate groove and said rigid member comprises an elongate pin.

8. A power tong as claimed in claim 6 having a pair of recesses with each recess providing near and remote boundaries for preventing overcamming and for alignment of tong parts.

9. A power tong as claimed in claim 8 wherein said recesses are arcuate grooves spaced apart and positioned on opposite sides of the center line of the rotary gear.

10. A power tong as claimed in claim 9 wherein said rigid member is a pin mounted by said upper cage plate for selective positioning in either said first or second arcuate groove through first and second apertures formed in said upper cage plate, a first of said grooves and apertures cooperating for use in conjunction with make up operations and a second of said grooves and apertures cooperating in break out operations.

* * * * *